United States Patent [19]

Yanadori et al.

[11] Patent Number: 4,541,261

[45] Date of Patent: Sep. 17, 1985

[54] METHOD OF PRODUCING HEAT PIPE

[75] Inventors: Michio Yanadori, Hachioji; Toshiaki Kawabata, Tokyo, both of Japan

[73] Assignee: Hitachi, Ltd., Tokyo, Japan

[21] Appl. No.: 532,110

[22] Filed: Sep. 14, 1983

[30] Foreign Application Priority Data

Sep. 22, 1982 [JP] Japan ..... 57-163874

[51] Int. Cl.[4] ..... B23P 15/26

[52] U.S. Cl. ..... 72/112; 72/370; 165/104.26; 29/157.3 H; 29/157.3 AH

[58] Field of Search ..... 165/104.26; 29/157.3 R, 29/157.3 AH, 157.3 H, 597, 157.3 D; 72/68, 112, 370

[56] References Cited

U.S. PATENT DOCUMENTS 4,004,441 1/1977 Lezak ..... 165/104.26 X

FOREIGN PATENT DOCUMENTS 1036804 8/1978 Canada ..... 29/157.3 AH
0087794 7/1981 Japan ..... 165/104.26
0114632 9/1981 Japan ..... 29/157.3 R

*Primary Examiner*—Howard N. Goldberg
*Assistant Examiner*—John T. Burtch
*Attorney, Agent, or Firm*—Antonelli, Terry & Wands

[57] ABSTRACT

A heat pipe is provided with a multiplicity of longitudinal deep grooves and ridges formed in the inner peripheral surface thereof. A plurality of shallow grooves are formed by a plastic work in the top surfaces of the longitudinal ridges separating the deep grooves. Parts of burrs formed as a result of the plastic work for forming the shallow grooves are extended over the deep groove so as to form bridges connecting adjacent ridges over the deep grooves.

5 Claims, 10 Drawing Figures

METHOD OF PRODUCING HEAT PIPE

BACKGROUND OF THE INVENTION

1. Field of the Invention

The present invention relates to a novel construction of a heat pipe which conveys heat by making use of evaporation and condensation of a liquid, as well as a method of producing the same. More particularly, the invention is concerned with a method of producing a heat pipe suitable for use in the cooling of dynamic electric machines, machine tools or the like apparatus.

2. Description of the Prior Art

A typical known heat pipe is constituted by a closed vessel made of copper, aluminum or the like material and provided in the inner surface thereof with a multiplicity of longitudinal grooves adapted for performing a capillary action. The heat pipe of the type mentioned above is often used at such a gradient that the heated end thereof takes a higher level than the other end. In such a use, the liquid condensed at the colder other end of the heat pipe has to climb up to the heated end by the capillary action, overcoming the force of gravity. Unfortunately, however, the grooves can produce only a small capillary sucking effect, so that the heat pipe can be used only at a slight gradient.

On the other hand, the specification of U.S. Pat. No. 3,543,841 discloses a heat pipe in which the closed vessel is lined at its inner side with a wick to enhance the capillary action. The use of the wick, however, imposes other problems such as a rise in the production cost, greater tendency of clogging and greater resistance to heat transfer.

SUMMARY OF THE INVENTION

Object of the Invention

Accordingly, an object of the invention is to provide a less-expensive heat pipe which can be used at a greater gradient thanks to an enhanced capillary effect, thereby to overcome the above-described problems of the prior art.

Brief Summary of the Invention

To this end, according to the invention, there is provided a heat pipe having a closed vessel provided in the inner wall thereof with a multiplicity of longitudinal deep grooves separated by longitudinal ridges, wherein a multiplicity of shallow grooves are formed by a plastic work in the top surfaces of the ridges so as to intersect the deep grooves, and the burrs produced as a result of formation of the shallow grooves are extended to form bridges between adjacent ridges over the deep groove therebetween, thereby to enhance the capillary effect of the heat pipe.

The above and other objects, features and advantages of the invention will become clear from the following description of the preferred embodiments taken in conjunction with the accompanying drawings.

DESCRIPTION OF THE PREFERRED EMBODIMENT

Figure 1:
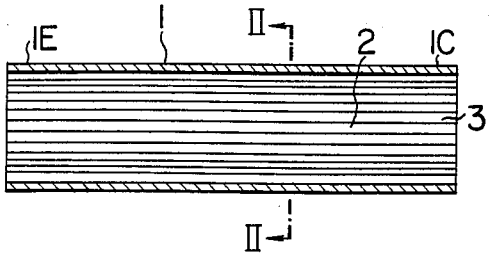
FIG. 1 is a longitudinal sectional view of a heat pipe under an intermediate step of production method in accordance with the present invention.

FIGS. 1 to 6 in combination show a first embodiment of the invention. The first embodiment of the heat pipe of the invention has a closed vessel 1 which is provided with a multiplicity of longitudinal deep grooves 2 and ridges 3, as shown in FIG. 1. In addition, a plurality of shallow grooves 4 are formed on the top surfaces of the ridges separating the deep grooves 2 so as to intersect the deep grooves 2, as will be seen from FIG. 3. The burrs 5 produced by the formation of the shallow grooves 4 are extended into contact with adjacent ridge 3 thereby to form a plurality of bridges between adjacent ridges 3. For instance, the deep grooves 2 are formed to have a depth of 0.5 mm and a width of 0.2 to 0.5 mm, while the ridges 3 are made to have a width of 0.5 mm. The shallow grooves 4 are then formed in the top surfaces of the ridges 3 to have a depth of 0.1 to 0.2 mm. The angle formed between the longitudinal deep grooves 2 and the shallow grooves 4 is preferably selected to be between 20° and 80°. The pitch $P_1$ of the shallow grooves 4 is preferably selected in relation to the width $P_0$ of the shallow grooves such that the ratio $P_0/P_1$ takes a value ranging between 1/5 and 2/1.

The heat tube of the invention offers the following advantages. Namely, the longitudinal grooves can exhibit greater capillary effect due to the surface tension on the inner surfaces of the burrs 5, i.e. the bridges when the liquid passes the deep grooves 2. In fact, 20 to 60% improvement of the capillary effect can be attained although the increment varies depending on the number of shallow grooves 4 and the size of the burrs 5.

In addition, by providing the shallow grooves 4 in the evaporating section (one end 1E of the heat tube), the liquid in the deep grooves 2 is sucked into the shallow grooves 4 due to the capillary action of the shallow grooves. In consequence, the heat transfer area in the evaporating section is increased by an amount corresponding to the area presented by the shallow grooves. In consequence, the undesirable tendency of dry-out is suppressed against the large heat input.

An increase of the capillary effect by 3 to 4 times is attainable by oxidating the inner surfaces of the deep grooves 2, the inner surfaces of the burrs 5 and the shallow grooves 4 after the formation of the deep grooves 2 and the shallow grooves 4.

In order to reduce the resistance against the flow of liquid in the deep groove 2 and to attain a greater flow rate of the liquid thereby and to achieve a greater rate of heat conveyance, the deep groove 2 preferably has a rectangular, inversed trapezoidal or semi-circular cross-section, while the shallow groove 4 preferably has a mountain-shaped or semi-circular cross-section, for the reasons which will be explained hereinunder. If both of the deep groove 2 and the shallow groove 4 have mountain-like form, it is difficult to form burrs 5 or only a small amount of burrs even can be formed, when the shallow grooves are formed on the top surface of the ridges. In addition, shallow grooves 4 having rectangular cross-section can hardly be formed on the top surfaces of the ridges 3.

Figure 5:
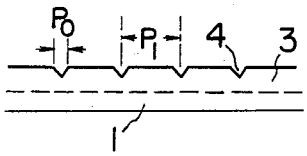
FIG. 5 is a sectional view taken along the line V—V of FIG. 3.
Figure 6:
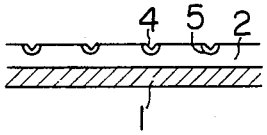
FIG. 6 is a sectional view taken along the line VI—VI of FIG. 3.

When the shallow groove 4 has a mountain-shaped cross-section as shown in FIGS. 5 and 6, the outer configuration of the cross-section of burrs 5 is also mountain-shaped. The mountain-shaped outer configuration of the burrs 5 causes smaller pressure drop of the liquid flowing in the deep grooves 2 than the burrs having rectangular outer configuration.

Figure 7:
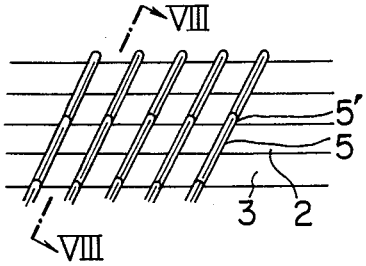
FIG. 7 is an illustration of another embodiment of the invention.
Figure 8:
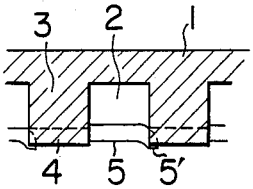
FIG. 8 is a sectional view taken along the line VIII—VIII of FIG. 7.

FIGS. 7 and 8 show another embodiment of the invention in which the each burr 5 formed as a result of formation of the shallow grooves on the top surfaces of the ridges 3 extends above the deep groove 2 to keep one end 5' thereof in close contact with the adjacent ridge 3. In order to make sure of this condition, it is preferred that the end 5' of the burr 5 overlies the adjacent ridge 3. According to this arrangement, it is possible to further enhance the capillary action of the deep grooves 2. This shape is formed by reducing the diameter of the closed vessel 1 after conducting said formation.

Figure 2:
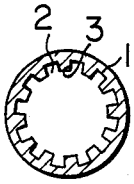
FIG. 2 is a sectional view taken along the line II—II of FIG. 1.
Figure 3:
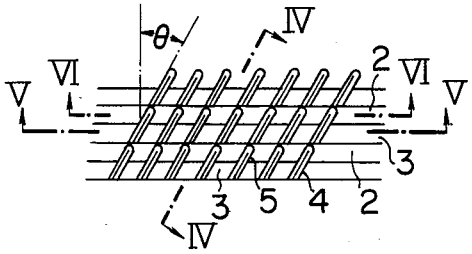
FIG. 3 is an illustration of grooves formed in the inner wall of a heat pipe in accordance with the invention.
Figure 4:
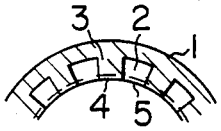
FIG. 4 is sectional view taken along the line IV—IV of FIG. 3.
Figure 9:
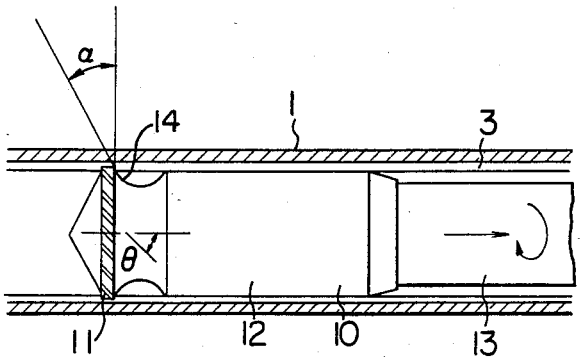
FIG. 9 is an illustration of a method of machining the grooves in the heat pipe of the invention.
Figure 10:
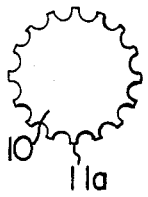
FIG. 10 is an illustration of the cutting edge section of a second drawing tool as used in the machining illustrated in FIG. 9.

FIGS. 9 and 10 illustrate a method for producing a heat pipe in accordance with the invention. As the first step, the deep grooves 2 as shown in FIGS. 1 and 2 are formed in the inner surface of the closed vessel by a plastic work conducted by means of a first drawing tool. Then, the shallow grooves are formed on the top surfaces of the ridges 3 by a plastic work by means of a second drawing tool 10. The second drawing tool 10 is composed of a cutting edge section 11 on which cutting edges 11*a* are formed at a helical angle $\theta$, a relief portion 14, a guide portion 12 having an outside diameter equal to the diameter of the top surface of the ridge 3 in the vessel 1, and a shaft portion 13 of a diameter smaller than that of the guide portion. The rake angle $\theta$ behind the cutting edge section 11 is selected to preferably range between 20° and 60°. For forming the shallow grooves 4, the second tool is withdrawn in the direction of the arrow while being rotated. Thereafter, the vessel is subjected to an oxidation treatment and both ends thereof are processed to form a closed vessel.

It is possible to incline the deep grooves 2 with respect to the axis of the vessel by slightly rotating the first tool during machining of the deep grooves 2. The helical angle or angle $\theta$ of twisting of the deep grooves 2 with respect to the longitudinal axis of the closed vessel preferably ranges between 20° and 80°.

During the processing by the second drawing tool, the chips of metal cut and removed from the pipe wall are temporarily accumulated in the relief portion 14 behind the cutting edge section, so that the aimed burrs are formed successfully without being adversely affected by the chips of the metal.

As a measure for forming the bridges between adjacent ridges, it is possible to insert a cylindrical copper network of fine mesh into the vessel after the formation of the deep grooves and shallow grooves. In such a case, the bridges are constituted by both of the burrs produced during formation of the shallow grooves and the network of the copper cylinder.

As has been described, according to the invention, the capillary effect of the grooves in the heat pipe is enhanced thanks to the provision of the shallow grooves and bridges over the grooves, so that the heat pipe can be used at a greater gradient than the conventional heat pipes, without substantially impairing the heat conveying capacity. In addition, this heat pipe can be produced by a costless method which is also presented by the present invention. Although the invention has been described through specific terms, it is to be noted that the described embodiments are only illustrative and various changes and modifications may be imparted thereto without departing from the claimed scope of the invention.

We claim:

1. A method of producing a heat pipe comprised of a closed vessel filled with a liquid adapted for evaporation and condensation in said closed vessel, said closed vessel having an inner surface which is provided with a multiplicity of longitudinal deep grooves which move the liquid by capillary action thereby to convey heat from one to the other end of said closed vessel, said method comprising: drawing a rotating drawing tool through the pipe provided with the deep grooves to form, by plastically working, a plurality of shallow grooves in the top surfaces of ridges separating said deep grooves so as to intersect said deep grooves, and to form a plurality of spaced bridges connecting adjacent ridges by burrs which are produced during the formation of the shallow grooves on the top surfaces of the ridges, thereby to enhance the capillary effect produced by said deep grooves.

2. A method of producing a heat pipe according to claim 1, wherein each of said deep grooves has a rectangular cross-section while each of said shallow grooves has a mountain-shaped cross-section.

3. A method of producing a heat pipe according to claim 1, wherein the helical angle $\theta$ of said shallow grooves with respect to said deep grooves ranges between 20° and 80°.

4. A method of producing a heat pipe according to claim 1, wherein the surfaces of said deep grooves, shallow grooves and said bridges are subjected to an oxidation treatment.

5. A method of producing a heat pipe according to claim 1, wherein said bridges are constituted by said burrs and a metallic network.

* * * * *